US012181263B2

(12) United States Patent
Walker et al.

(10) Patent No.: US 12,181,263 B2
(45) Date of Patent: Dec. 31, 2024

(54) FIREARM PROJECTILE

(71) Applicant: Seismic Ammunition, Inc., Oklahoma City, OK (US)

(72) Inventors: Steven Brett Walker, Austin, TX (US); Matthew Wilkes, Oklahoma City, OK (US)

(73) Assignee: SEISMIC AMMUNITION, INC., Oklahoma City, OK (US)

( * ) Notice: Subject to any disclaimer, the term of this patent is extended or adjusted under 35 U.S.C. 154(b) by 0 days.

(21) Appl. No.: 18/097,799

(22) Filed: Jan. 17, 2023

(65) Prior Publication Data

US 2023/0228544 A1 Jul. 20, 2023

Related U.S. Application Data

(60) Provisional application No. 63/300,207, filed on Jan. 17, 2022.

(51) Int. Cl.

| | |
|---|---|
| ***F42B 7/08*** | (2006.01) |
| ***F42B 7/12*** | (2006.01) |
| ***F42B 12/34*** | (2006.01) |
| ***F42B 14/06*** | (2006.01) |

(52) U.S. Cl.

CPC ..... *F42B 7/08* (2013.01); *F42B 7/12* (2013.01); *F42B 12/34* (2013.01); *F42B 14/064* (2013.01)

(58) Field of Classification Search

CPC .... F42B 7/08; F42B 7/12; F42B 12/34; F42B 14/064

USPC ..... 102/439, 450

See application file for complete search history.

(56) References Cited

U.S. PATENT DOCUMENTS

| | | | | | |
|---|---|---|---|---|---|
| 44,492 | A * | 9/1864 | Name not available | ..... | F42B 12/34 102/525 |
| 1,023,469 | A * | 4/1912 | Name not available | ..... | F42B 12/34 102/510 |
| 1,062,919 | A * | 5/1913 | Johnson | ..... | F42B 12/34 102/509 |
| 1,216,802 | A * | 2/1917 | Hawkins | ..... | F42C 15/22 102/243 |
| 1,300,195 | A * | 4/1919 | Rockwell | ..... | F42B 12/44 102/364 |
| 2,398,287 | A * | 4/1946 | Christie | ..... | F42B 12/44 102/364 |
| 3,003,420 | A * | 10/1961 | Nosler | ..... | F42B 12/34 102/508 |
| 3,127,837 | A * | 4/1964 | Lockwood | ..... | F42B 7/08 102/461 |
| 3,285,174 | A * | 11/1966 | Moehlman | ..... | F42B 7/08 102/451 |
| 3,623,431 | A * | 11/1971 | Hendricks | ..... | F42B 7/08 102/452 |
| 3,672,304 | A * | 6/1972 | Rogers | ..... | F42B 10/42 102/501 |
| 3,762,329 | A * | 10/1973 | Mawhinney | ..... | F42B 12/34 102/448 |

(Continued)

FOREIGN PATENT DOCUMENTS

| | | | | | |
|---|---|---|---|---|---|
| CN | 112304165 | A * | 2/2021 | ..... | F42B 12/02 |

*Primary Examiner* — Samir Abdosh

(74) *Attorney, Agent, or Firm* — McAfee & Taft

(57) ABSTRACT

A firearm projectile has a rear section and a forward section spaced from the rear section. A collapsible spacer is positioned between the forward section and the rear section.

16 Claims, 4 Drawing Sheets

(56) References Cited

U.S. PATENT DOCUMENTS 3,788,224 A * 1/1974 Merritt ..... F42B 7/08 102/450
3,866,536 A * 2/1975 Greenberg ..... F42B 12/34 244/3.1
4,136,616 A * 1/1979 Schirneker ..... F42B 12/34 102/510
4,301,737 A * 11/1981 Yuhash ..... F42B 12/06 102/493
4,776,279 A * 10/1988 Pejsa ..... F42B 12/34 102/514
5,121,693 A * 6/1992 Kosteck ..... F42B 7/12 102/466
5,149,913 A * 9/1992 Arakaki ..... F42B 12/34 102/517
6,675,718 B1 * 1/2004 Parker ..... F42B 12/34 102/514
7,690,311 B1 * 4/2010 Cronemberger ..... F42B 12/40 102/512
8,307,768 B2 * 11/2012 Cziglenyi ..... F42B 12/34 102/439
10,107,604 B1 * 10/2018 Spaulding ..... F42B 7/08
11,287,230 B1 * 3/2022 Sclafani ..... F42B 7/08
11,662,186 B2 * 5/2023 Cooke ..... F42B 5/184 102/439
2005/0235860 A1 * 10/2005 Gardner ..... F42B 7/08 102/449
2013/0145951 A1 * 6/2013 Nauman ..... F42B 7/04 102/448
2015/0268021 A1 * 9/2015 Whitworth ..... F42B 7/08 102/529
2020/0141708 A1 * 5/2020 Morse ..... F42B 12/74
2020/0158481 A1 * 5/2020 Buys ..... F42B 10/26
2020/0256654 A1 * 8/2020 Burrow ..... F42B 12/74
2023/0045740 A1 * 2/2023 Hurt ..... F42B 12/78

* cited by examiner

FIREARM PROJECTILE

CROSS-REFERENCE TO RELATED APPLICATION

This application claims the benefit of U.S. Provisional Application No. 63/300,207 filed on Jan. 17, 2022, which is hereby incorporated by reference.

Shotgun shells come in a variety of types and sizes and include different types of firearm projectiles. One type of firearm projectile used in a shotgun shell is referred to as a slug, which is a single solid firearm projectile fired through a shotgun barrel. Existing slugs have a tendency to cause spalling and shrapnel.

DESCRIPTION OF AN EMBODIMENT

Figure 1:
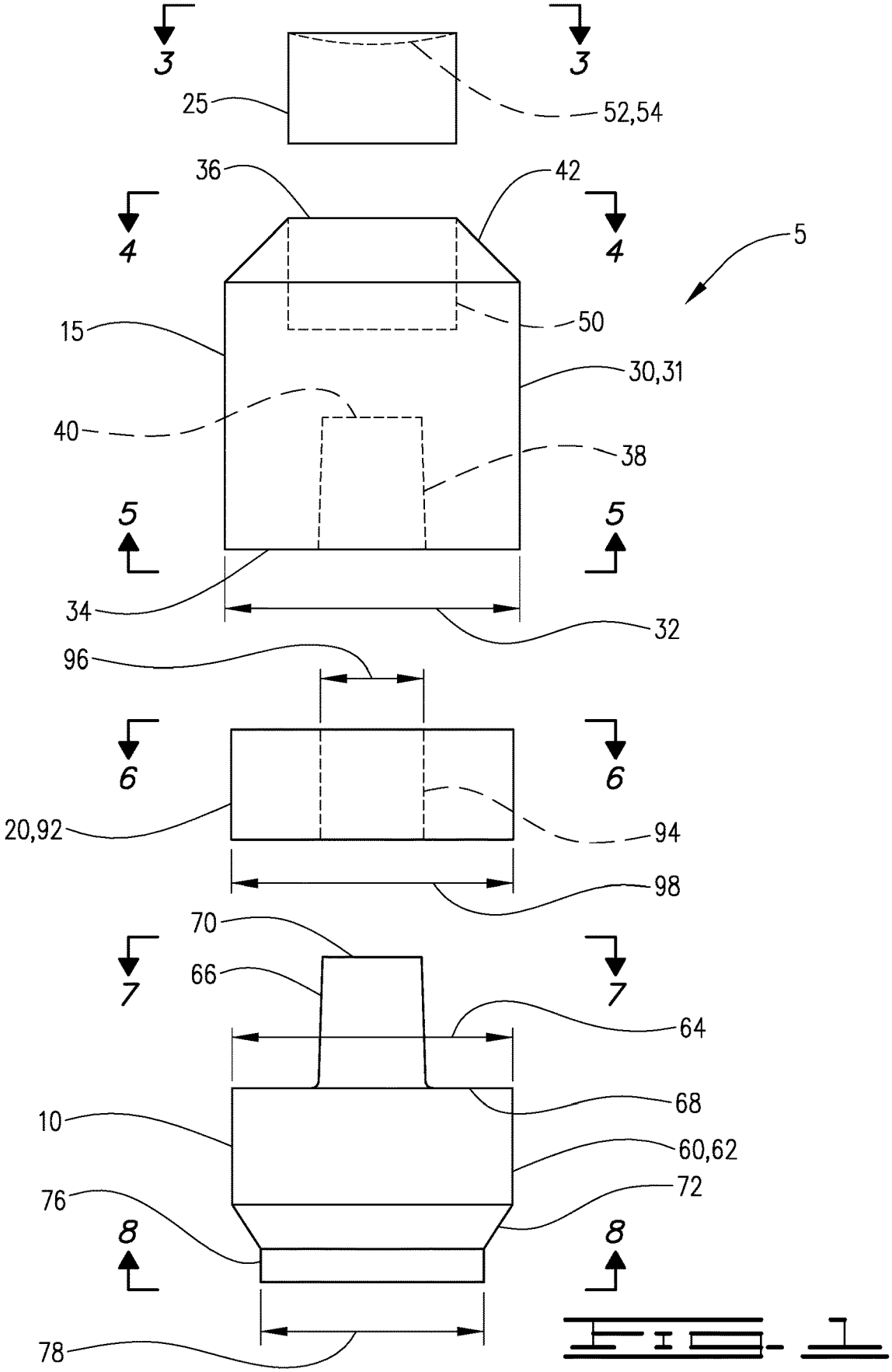
FIG. 1 is an exploded view of a firearm projectile of the current disclosure.
Figure 3:
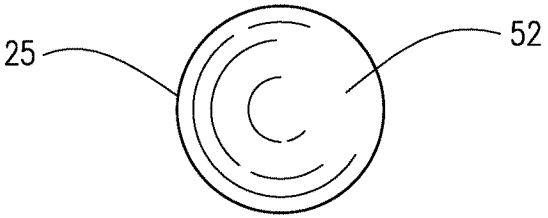
FIG. 3 is a view of the tip of the firearm projectile.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Figure 2:
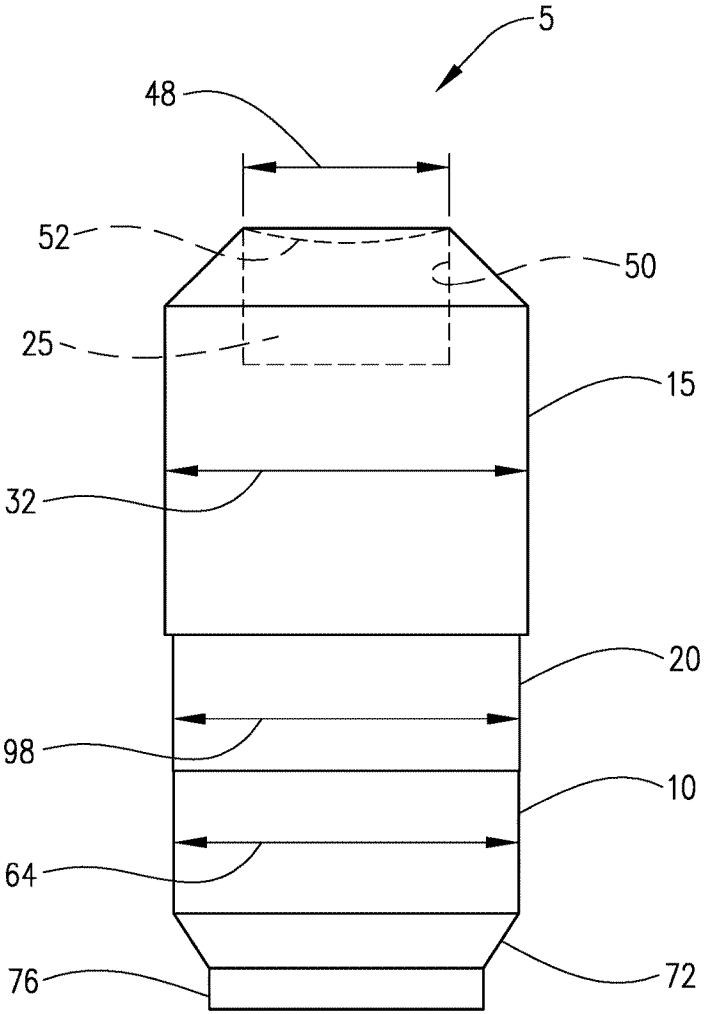
FIG. 2 is an elevation view of an assembled firearm projectile of the current disclosure.
Figure 5:
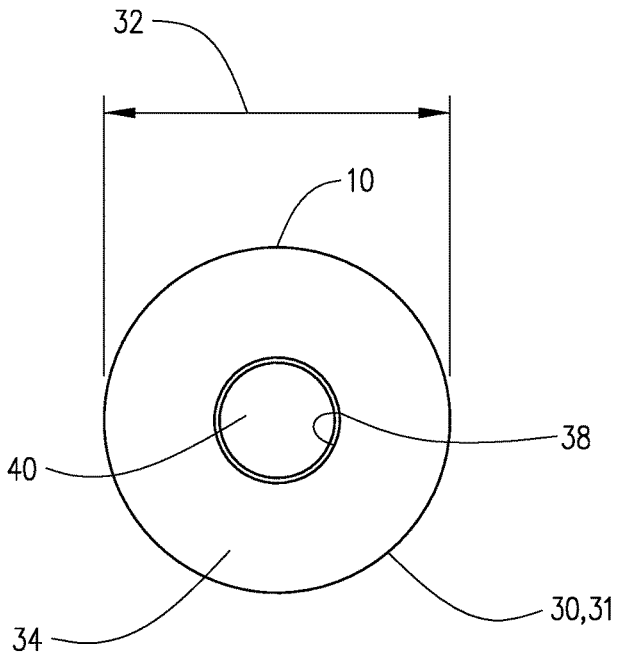
FIG. 5 is a view from line 5-5 of FIG. 1.
Figure 6:
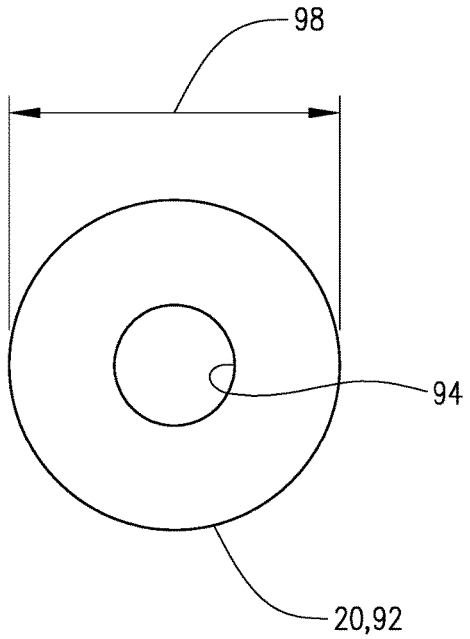
FIG. 6 is a view from line 6-6 of FIG. 1.
Figure 7:
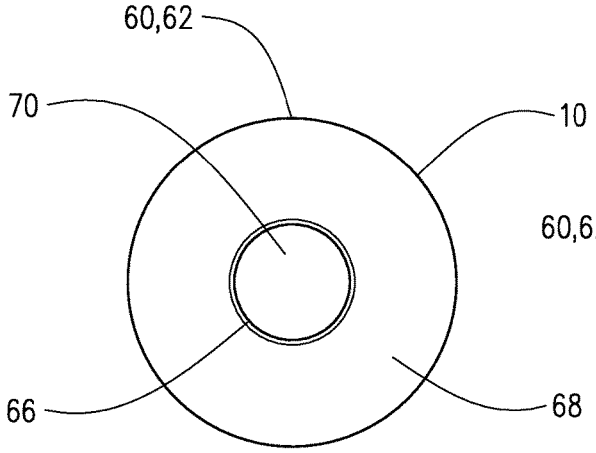
FIG. 7 is a view from line 7-7 of FIG. 1.
Figure 8:
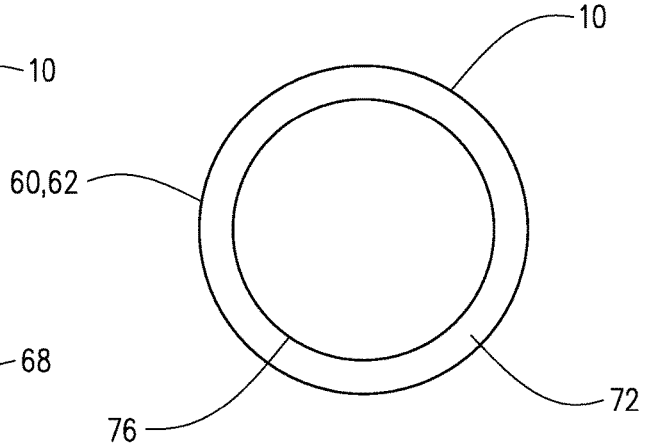
FIG. 8 is a view from line 8-8 of FIG. 1.

FIGS. 1 and 2 show a firearm projectile 5 that may be fired from a weapon such as for example a shotgun. In one embodiment the firearm projectile 5 is a slug and may be a multi-piece or multi-component slug 5. Firearm projectile 5 generates a double impact on the object that is struck, or impacted by the firearm projectile 5. The double impact may also be referred to as a sliding hammer action. Firearm projectile 5 is configured to impact and pass through objects and will alleviate and in some cases eliminate the shrapnel and/or spalling that occurs with prior art slugs.

Firearm projectile 5 comprises a rear section 10, which may be referred to as trailing section 10, and a forward section which may be referred to as a leading section 15. Rear and forward sections 10 and 15 are discrete sections. In other words, rear and forward sections 10 and 15 are separate pieces. A collapsible spacer 20, which may be referred to as a center section 20 is positioned between rear and forward sections 10 and 15 respectively. Collapsible spacer 20 is a collapsible, or crushable spacer that will collapse upon impact of the firearm projectile. In the embodiment described collapsible spacer 20 is a separate distinct piece from both the rear and forward sections 10 and 15 respectively. A firearm projectile tip 25 may be disposed in a cavity 50 in forward section 15. As detailed below, firearm projectile tip 25 may be of the same or different material than that from which forward section 15 is made.

In one embodiment of the firearm projectile 5, the rear and forward sections 10 and 15 may be made from the same material, which may be for example a 4140 steel. In one embodiment the forward and rear sections 10 and 15 are nitrided steel. The nitriding process prevents rust and also provides a hardened outer surface for the rear and forward sections 10 and 15. Firearm projectile tip 25 may be comprised of a tungsten carbide or other material that is harder than the surrounding portion of forward section 15.

Forward section 15 may comprise a body 31 with a generally cylindrical body portion 30. Body portion 30 has outer diameter 32, which in the described embodiment is a maximum outer diameter of forward section 15. Body 31 has a rear end 34 and a forward end 36. An opening 38 extends forward from rear end 34 and is slightly tapered radially inwardly from the rear end 34 of generally cylindrical body portion 30 to the forward end 40 of opening 38. Forward section 15 tapers radially inwardly from a forward end of generally cylindrical body portion 30 to the forward end 36 of body 30. Forward section 15 thus has a tapered portion 42 that extends forward from cylindrical portion 30.

Figure 4:
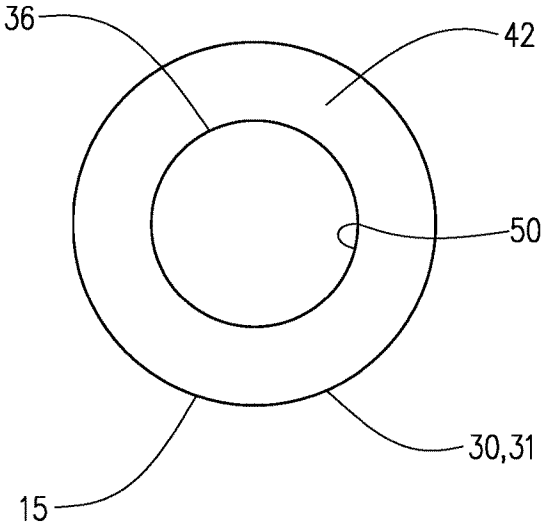
FIG. 4 is a view from line 4-4 of FIG. 1.

Forward end 36 of body 30 has a diameter 48 that is smaller than diameter 32. Cavity 50 is defined in the forward end 36 of forward section 15. Cavity 50 is a generally cylindrical cavity, but may for example have a rounded bottom. FIG. 4 shows an embodiment wherein the cavity 50 has a rounded bottom. Firearm projectile tip 25 is fixedly inserted into cavity 50 with, for example an adhesive. In the described embodiment the forwardmost surface 52 of firearm projectile tip 25 is concave and forms a concave depression 54. Although in the embodiment described firearm projectile 5 has a separate firearm projectile tip 25, it is not necessary that a separate firearm projectile tip 25 be used. In some embodiments the concave depression 54 may simply be defined in the forward end 36 of forward section 15. The concavity results in a frustum that produces a stress wave, thereby recusing spalling and creation of shrapnel at impact.

Rear section 10 comprises a body 60 with cylindrical portion 62 having a diameter 64. Diameter 64 is in one embodiment less than diameter 32. A tapered stem, or plunger 66 extends forward from the forward end 68 of cylindrical portion 62. Plunger 66 has a forward end 70. Rear section 10 tapers radially inwardly and rearwardly from cylindrical portion 62 and has tapered portion 72. A cylindrical portion 76 having a diameter 78 extends rearwardly from tapered portion 72. Diameter 78 is smaller than diameter 64.

Collapsible spacer 20 of firearm projectile 5 may comprise a collapsible foam or other material that can be crushed, or collapsed. Collapsible spacer 20 is in one embodiment a cylindrical spacer 92 with an opening 94 therein. Opening 94 has a diameter 96 at the rear end of spacer 20 and is at least large enough to allow the passage of plunger 66 therethrough. The collapsible spacer 20 may have an outer diameter 98 that is the same as or slightly larger or smaller than diameter 32.

As shown in FIG. 2 the assembly of firearm projectile 5 is relatively simple. Collapsible spacer 20 is placed over plunger 66 which is then inserted into opening 38 in forward section 15. The opening 38 is sized such that the plunger may be pushed therein sufficiently to create a tight enough fit so that rear and forward sections 10 and 15 will not separate from one another during travel of the firearm projectile. Firearm projectile tip 25 may be bonded or otherwise fixed to forward section 15.

Figure 10:
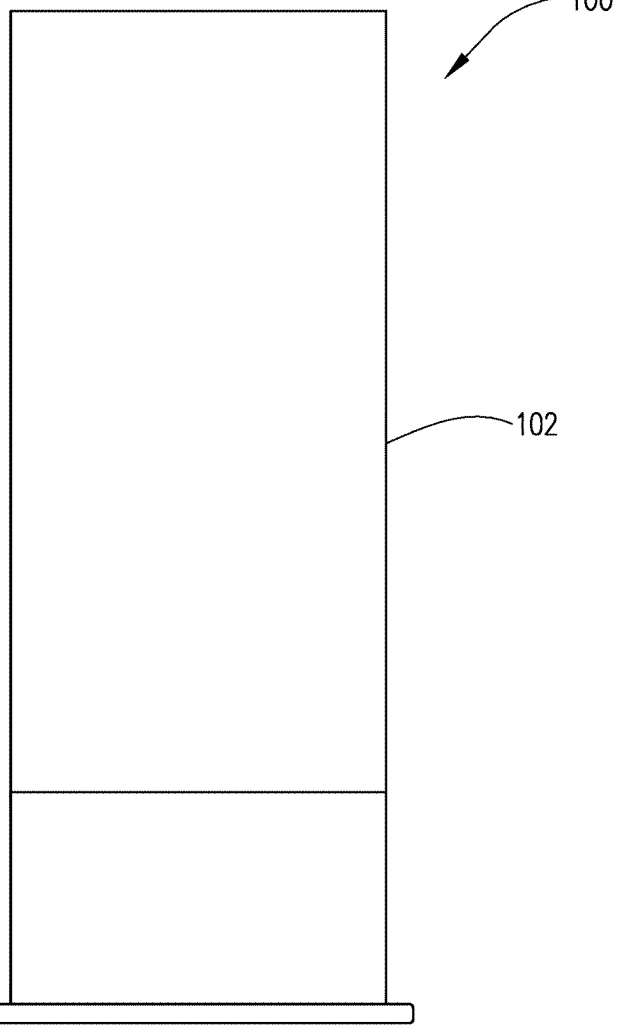
FIG. 10 is an elevation view of a shotgun shell.
Figure 9:
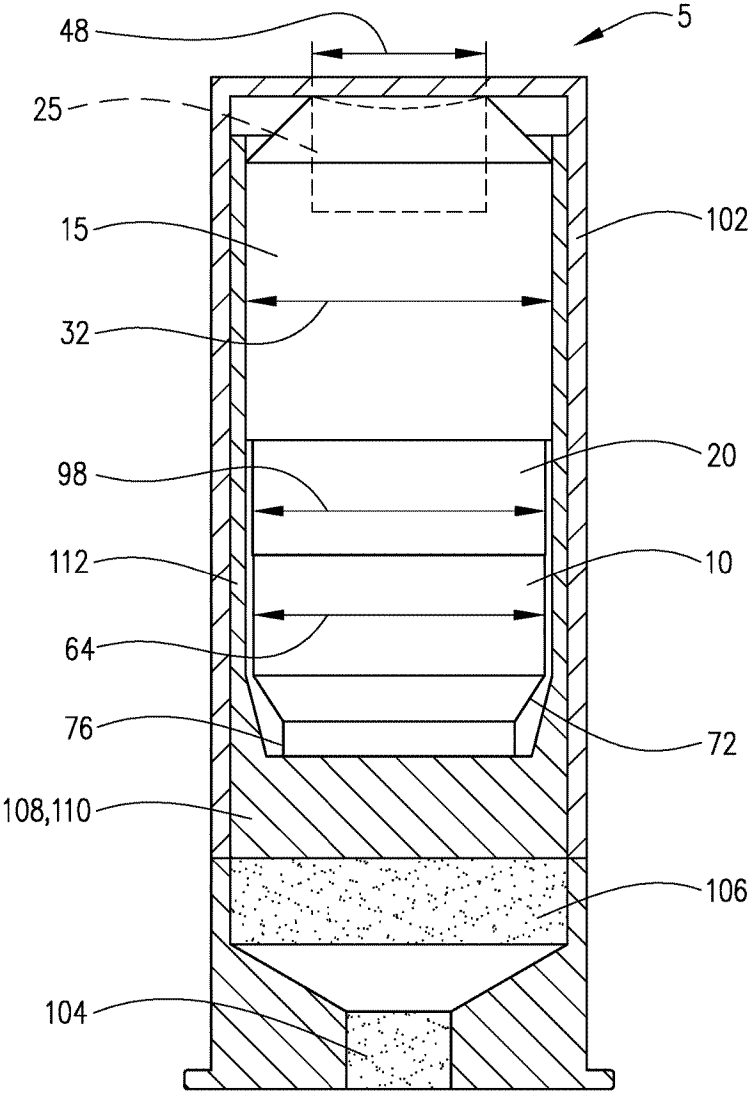
FIG. 9 is a view of an assembled shotgun shell with the outer case and wad in cross section.

When assembled, firearm projectile 5 will be placed in a shotgun shell casing and will have a wad of a type known in the art extending from the rear end to the forward end thereof. FIG. 10 shows an elevation view of a shotgun shell, and FIG. 9 shows a cross section of a shotgun shell outer case with the firearm projectile 5 therein. Shotgun shell 100 includes outer case 102, primer 104, gunpowder 106 and a wad 108. Wad 108 is comprised of a wad 110 and a wad sheath 112. Wad sheath 112 may have slits therein as are known in the art. Wad sheath 112 extends forward from the wad base forward to circumscribe at least a portion of the projectile 5.

The outer diameter 64 on rear section 10 is less than diameter 32 of forward section 15. Rear section 10 will rest freely in the wad or container 108 for the firearm projectile 5 while the forward section 15 will in some embodiments be friction-fit into the wad or other container. If desired, the forward section 15 may be bonded to the wad. Firearm projectile 5 is to be constructed and assembled such that the center of gravity is forward of the center of pressure to provide dynamic stability. In the embodiment described the rear and forward sections 10 and 15 are made from the same material and thus are a material with the same density. In one embodiment the density of the forward and rear sections 10 and 15 should be at least as dense as steel which is approximately 7.8 g/cc. In other embodiments the rear section 10 may be of a different, denser material. However, the center of gravity must in any case be forward of the center of pressure for the assembled firearm projectile 5.

The collapsible spacer 20 is comprised of a material that has sufficient stiffness to prevent premature contact between the rear and forward sections. In other words, the spacer 20 will prevent closure of space 16 until impact of the firearm projectile with a target. The stiffness of spacer 20 must be such that upon impact the rear section 10 will crush the collapsible spacer 20 and allow the rear section 10 to impact forward section 15. When fired, the firearm projectile 5, which in the embodiment described is a shotgun slug 5, will travel through the barrel of the shotgun through which it is being fired and the rear and forward sections 10 and 15 will maintain separation. Upon impact by the forward section 15 with the object struck, the rear section 10 of firearm projectile 5 will continue moving forward and will close space 16 until it creates a second impact against the rear end 34 of forward section 15. The continued movement of rear section 10 relative to forward section 15 will crush, or collapse spacer 20 and will generate the impact with forward section 15. Collapsible spacer 20 will collapse. One exemplary material from which the collapsible spacer may be made is a super-cushioning ionomer foam sheet, part number 86205 K62 made by McMaster-Carr. Other materials may be used so long as the stiffness will maintain separation between rear and forward sections 10 and 15 until impact at which point the spacer 20 will collapse.

In testing, firearm projectile 5 has proven to be superior to existing slugs in terms of shrapnel and spalling generated upon impact. Tests were conducted with the firearm projectile of the current disclosure and a prior art slug by firing each through a sheet of 0.25" (one-quarter inch) 1018 steel and then through an aluminum sheet spaced therefrom. During the conduct of the test the aluminum sheet was spaced approximately 12" from the steel plate. There was no shrapnel resulting from the firearm projectile 5 passing through the steel plate. The size of the hole in the aluminum was clean and generally the same size as the hole in the steel plate. The result when the prior art slug was used was the creation of significant shrapnel which presented itself as multiple small holes through the aluminum plate.

Embodiments include:

Embodiment 1. A firearm projectile comprising a rear section; a forward section spaced from the rear section; and a collapsible spacer positioned between the forward section and the rear section.

Embodiment 2. The firearm projectile of embodiment 1, wherein the collapsible spacer collapses as a result of impact of the firearm projectile with a target at which the firearm projectile is fired.

Embodiment 3. The firearm projectile of either of embodiments 1 or 2, wherein the rear section impacts the forward section at a rear end thereof as a result of the forward section impacting a target at which the firearm projectile is fired.

Embodiment 4. The firearm projectile of any of embodiments 1-3 further comprising a projectile tip disposed in a cavity in the forward section of the firearm projectile.

Embodiment 5. The firearm projectile of any of embodiments 1-4, a forward surface of the forward section of the firearm projectile having a concave depression defined therein.

Embodiment 6. A firearm shell comprising the firearm projectile of any of embodiments 1-5 positioned in an outer case; and a shotgun shell wad positioned between primer in the outer case and the firearm projectile, the shotgun shell wad including a wad base between the primer and the firearm projectile and a sheath extending forward from the wad base to circumscribe at least a portion of the firearm projectile.

Embodiment 7. The firearm shell of embodiment 6, the shotgun shell wad being sufficiently fixed to the firearm projectile so that it stays attached to the firearm projectile after it is fired through the barrel of a firearm.

Embodiment 8. A firearm projectile comprising a forward section; a discrete rear section separated from the forward section, the forward section and rear section defining a space therebetween, the space comprising a closeable space, the forward section and discrete rear section maintaining separation during flight after the projectile is fired from a firearm.

Embodiment 9. The firearm projectile of embodiment 8, the impact of the projectile with a target causing the rear section to impact the forward section.

Embodiment 10. The firearm projectile of either of embodiments 8 or 9, further comprising a spacer positioned in the closeable space.

Embodiment 11. The firearm projectile of embodiment 10, the spacer comprising a collapsible spacer.

Embodiment 12. The firearm projectile of either of embodiments 10 or 11, the rear section having a support post extending in the forward direction from a forward surface of the rear section, the support post being received in openings in the spacer and the forward section.

Embodiment 13. The firearm projectile of any of embodiments 8-12, the rear section defining a rear section maximum outer diameter, the rear section maximum outer diameter being smaller than a maximum diameter of the forward section.

Embodiment 14. The firearm projectile of any of embodiments 8-13, the forward section having a cavity defined at the forward end thereof, further comprising a projectile tip fixed in the cavity.

Embodiment 15. A firearm projectile comprising discrete forward and rear sections defining a space therebetween; and a support post extending forward from the rear section into an opening defined in the forward section, the post being movable axially in the opening defined in the forward section upon impact of the firearm projectile with a target.

Embodiment 16. The firearm projectile of embodiment 15 further comprising a collapsible spacer positioned between the forward and rear sections.

Embodiment 17. The firearm projectile of either of embodiments 15 or 16, a maximum outer diameter of the forward section being greater than a maximum diameter of the rear section.

Embodiment 18. The firearm projectile of any of embodiments 15-17 further comprising a projectile tip inserted into a cavity defined in the forward end of the forward section.

Embodiment 19. The firearm projectile of embodiment 18 the projectile tip being comprised of a material harder than the material of which the forward section is comprised.

Embodiment 20. The firearm projectile of either of embodiments 18-19, the projectile tip defining a concave depression therein.

The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present disclosure.

What is claimed is:

1. A firearm projectile comprising:

a rear section;

a forward section spaced from the rear section; and a collapsible spacer positioned between the forward section and the rear section wherein the rear section impacts the forward section at a rear end thereof as a result of the forward section impacting a target at which the firearm projectile is fired.

2. The firearm projectile of claim 1, wherein the collapsible spacer collapses as a result of impact of the firearm projectile with a target at which the firearm projectile is fired.

3. The firearm projectile of claim 1 further comprising a projectile tip disposed in a cavity in the forward section of the firearm projectile.

4. The firearm projectile of claim 1, a forward surface of the forward section of the firearm projectile having a concave depression defined therein.

5. A firearm shell comprising:

the firearm projectile of claim 1 positioned in an outer case;

a shotgun shell wad positioned between primer in the outer case and the firearm projectile, the shotgun shell wad including a wad base between the primer and the firearm projectile and a wad sheath extending forward from the wad base to circumscribe at least a portion of the firearm projectile.

6. The firearm shell of claim 5, the shotgun shell wad being sufficiently fixed to the firearm projectile so that it stays attached to the firearm projectile after it is fired through the barrel of a firearm.

7. A firearm projectile comprising:

a forward section;

a discrete rear section separated from the forward section, the forward section and rear section defining a space therebetween, the space comprising a closeable space, the forward section and discrete rear section maintaining separation during flight after the projectile is fired from a firearm; and a collapsible spacer positioned in the closeable space, the impact of the projectile with a target causing the rear section to impact the forward section.

8. The firearm projectile of claim 7, the rear section having a stem extending in the forward direction from a forward surface of the rear section, the support post being received in openings in the spacer and the forward section.

9. The firearm projectile of claim 7, the rear section defining a rear section maximum outer diameter, the rear section maximum outer diameter being smaller than a maximum diameter of the forward section.

10. The firearm projectile of claim 7, the forward section having a cavity defined at the forward end thereof, further comprising a projectile tip fixed in the cavity.

11. A firearm projectile comprising:

discrete forward and rear sections defining a space therebetween;

a stem extending forward from the rear section into an opening defined in the forward section, the stem being movable axially in the opening defined in the forward section upon impact of the firearm projectile with a target; and a collapsible spacer positioned between the forward and rear sections.

12. The firearm projectile of claim 11, a maximum outer diameter of the forward section being greater than a maximum diameter of the rear section.

13. The firearm projectile of claim 11 further comprising a projectile tip inserted into a cavity defined in the forward end of the forward section.

14. The firearm projectile of claim 13, the projectile tip being comprised of a material harder than the material of which the forward section is comprised.

15. The firearm projectile of claim 13, the projectile tip defining a concave depression therein.

16. The firearm projectile of claim 1 further comprising a stem extending forward from the rear section into an opening defined in the forward section.

* * * * *